US008870590B2

(12) United States Patent
Hung

(10) Patent No.: US 8,870,590 B2
(45) Date of Patent: Oct. 28, 2014

(54) ELECTRICAL-CONDUCTIVE ASSEMBLY FOR SIGNAL CABLE AND CONNECITNG LINE

(75) Inventor: Jen-Yuan Hung, New Taipei (TW)

(73) Assignee: Amphenol LTW Technology Co., Ltd., New Taipei (TW)

( * ) Notice: Subject to any disclaimer, the term of this patent is extended or adjusted under 35 U.S.C. 154(b) by 257 days.

(21) Appl. No.: 13/481,452

(22) Filed: May 25, 2012

(65) Prior Publication Data

US 2013/0316596 A1 Nov. 28, 2013

(51) Int. Cl.
*H01R 4/24* (2006.01)

(52) U.S. Cl.
USPC ..... 439/408; 439/535; 174/78; 174/112

(58) Field of Classification Search
CPC ..... H01R 4/184
USPC ..... 439/535, 402–404; 174/78, 112
See application file for complete search history.

(56) References Cited

U.S. PATENT DOCUMENTS

| | | | | |
|---|---|---|---|---|
| 2,604,341 | A * | 7/1952 | Bergan | 403/188 |
| 2,615,948 | A * | 10/1952 | Ira | 439/535 |
| 2,696,518 | A * | 12/1954 | Ludwig et al. | 174/78 |
| 3,105,108 | A * | 9/1963 | Brazee | 174/112 |
| 3,197,729 | A * | 7/1965 | Sarazen | 439/422 |
| 3,602,872 | A * | 8/1971 | Braunstein | 439/425 |
| 4,403,821 | A * | 9/1983 | Zimmerman et al. | 439/408 |
| 5,011,428 | A * | 4/1991 | Heng et al. | 439/394 |
| 6,022,240 | A * | 2/2000 | McCleerey et al. | 439/410 |
| 7,234,961 | B2 * | 6/2007 | Arlitt et al. | 439/410 |
| 8,585,430 | B1 * | 11/2013 | Larner et al. | 439/391 |

FOREIGN PATENT DOCUMENTS

| | | | |
|---|---|---|---|
| DE | 19909322 | B4 | 10/1999 |
| DE | 102004007525 | A1 | 9/2005 |
| DE | 202008013288 | U1 | 5/2010 |
| DE | 202010008116 | U1 | 11/2010 |
| DE | 102009044809 | A1 | 6/2011 |
| DE | 69812774 | T2 | 10/2013 |

OTHER PUBLICATIONS

Search report issued by Deutsches Patent Office on Oct. 10, 2013.

* cited by examiner

*Primary Examiner* — Truc Nguyen
(74) *Attorney, Agent, or Firm* — Chun-Ming Shih; HDLS IPR Services

(57) ABSTRACT

An electrical-conductive assembly for a signal cable and a connecting line, includes a signal cable, a connecting line and an electrical-conductive means. The signal cable includes an outer insulation cover and a plurality of cores located in the outer insulation cover. The signal cable is continuous and provided with at least one electrical-conductive portion. A portion of the outer insulation cover on the electrical-conductive portion is removed to bare the cores. The connecting line has cores therein. One end of the connecting line is provided with a connecting portion. The cores of the connecting line are bare in the connecting portion. The electrical connection means electrically connects the cores of the connecting portion to the cores of the electrical-conductive portion.

4 Claims, 6 Drawing Sheets

ELECTRICAL-CONDUCTIVE ASSEMBLY FOR SIGNAL CABLE AND CONNECITNG LINE

BACKGROUND OF THE INVENTION

1. Field of the Invention

The present invention relates to an electrical-conductive assembly, and in particular to an electrical-conductive assembly for a signal cable and a connecting line, which is capable of reducing signal attenuation.

2. Description of Prior Art

With the advance of science and technology, more and more signals have to be transmitted via a signal cable. A plurality of connecting line is connected to the signal cable, so that the signals can be transmitted by these connecting lines from the signal cable to several desired locations. According to the existing level of this art, the signal cable has to be cut. One end of the cut signal cable is connected to one end of the connecting line via terminal elements. Then, the terminal elements are inserted into a terminal trough of a connector, so that the signal cable can be electrically connected to the connecting line. The other end of the connecting line is inserted into an electronic device. By means of the connector, the signals from the signal cable can be transmitted to the connecting line and finally transmitted to the electronic device.

However, signal cores inside the signal cable are not electrically connected to cores of the connecting line directly. Instead, the electrical connection between the signal cable and the connecting line is achieved by the terminal elements and the terminal trough of the connector, which inevitably generates signal attenuation and increased impendence. Thus, the manufacturers in this field attempt to propose a connector which is capable of reducing the signal attenuation. However, such an improvement is restricted because a certain degree of signal attenuation is inevitably generated as long as the signal cable is cut and an additional connector is provided.

Therefore, the present Inventor aims to solve the above-mentioned problems.

SUMMARY OF THE INVENTION

The present invention is to provide an electrical-conductive assembly for a signal cable and a connecting line, which is capable of reducing signal attenuation without cutting the signal cable The present invention provides an electrical-conductive assembly for a signal cable and a connecting line, including:

a signal cable, comprising an outer insulation cover and a plurality of cores located in the outer insulation cover, the signal cable being continuous and provided with at least one electrical-conductive portion, a portion of the outer insulation cover on the electrical-conductive portion being removed to bare the cores;

at least one connecting line, having a plurality of cores therein, one end of the connecting line being provided with a connecting portion, the cores of the connecting line being bare in the connecting portion; and an electrical connection means, configured to electrically connect the cores of the connecting portion to the cores of the electrical-conductive portion.

According to one aspect of the present invention, the electrical connection means includes a plurality of soldering portions or electrical-conductive members.

In comparison with prior art, the present invention has the following advantageous features:

According to the present invention, the signal cable is continuous (uncut) and provided with an electrical-conductive portion. Then, the connecting portion on one end of the connecting line is electrically connected to the electrical-conductive portion of the signal cable directly via the electrical connection means (a plurality of soldering portions or electrical-conductive members). Thus, the electrical-conductive assembly of the present invention allows the signal cable to be electrically connected to one end of the connecting line without cutting the signal cable. Therefore, the signal attenuation and impedance in the signal cable are reduced greatly.

DETAILED DESCRIPTION OF THE INVENTION

The detailed description and technical contents of the present invention will become apparent with the following detailed description accompanied with related drawings. It is noteworthy to point out that the drawings is provided for the illustration purpose only, but not intended for limiting the scope of the present invention.

Figure 1:
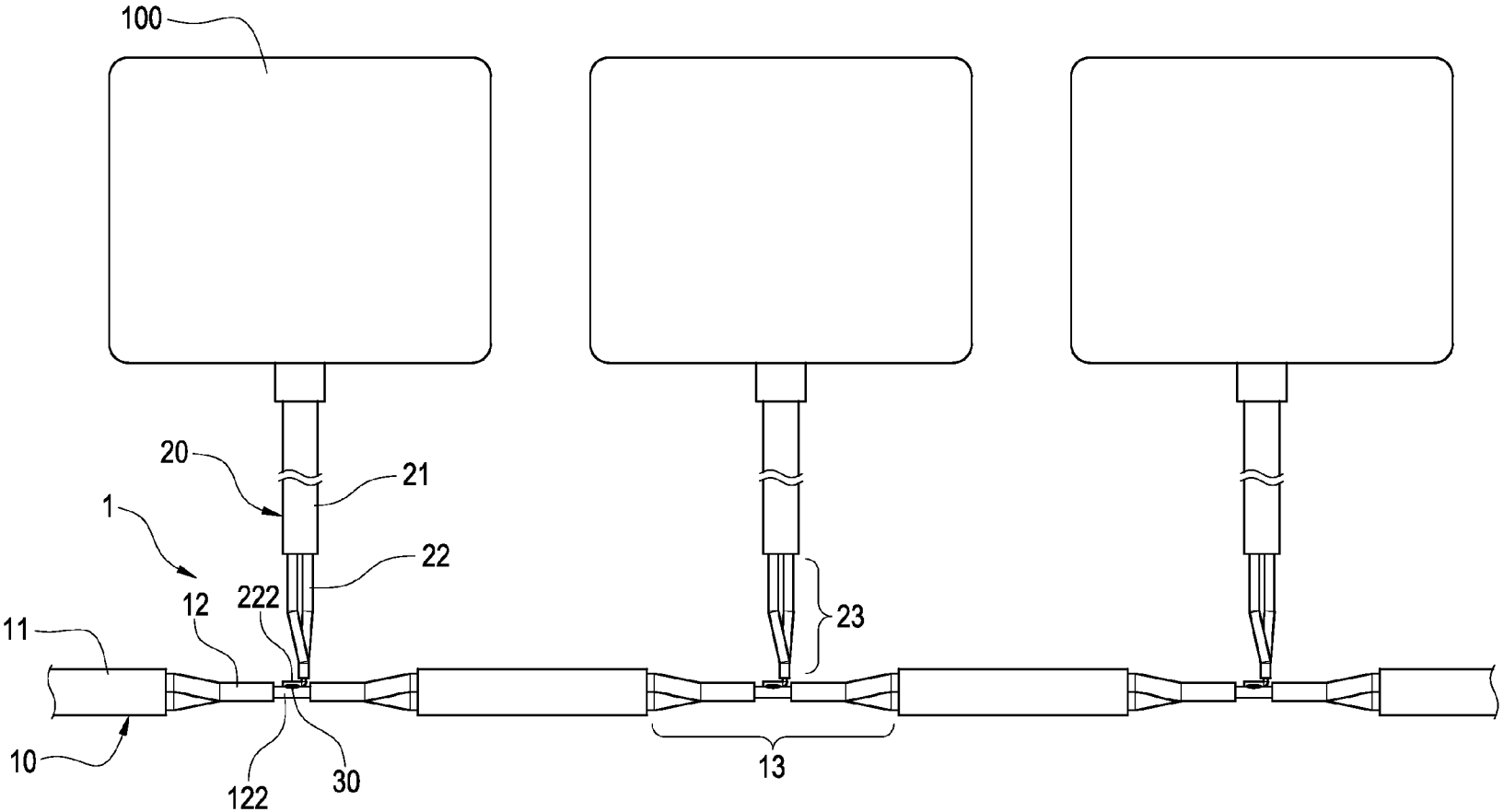
FIG. 1 is a schematic view showing the operation of the present invention.
Figure 2:
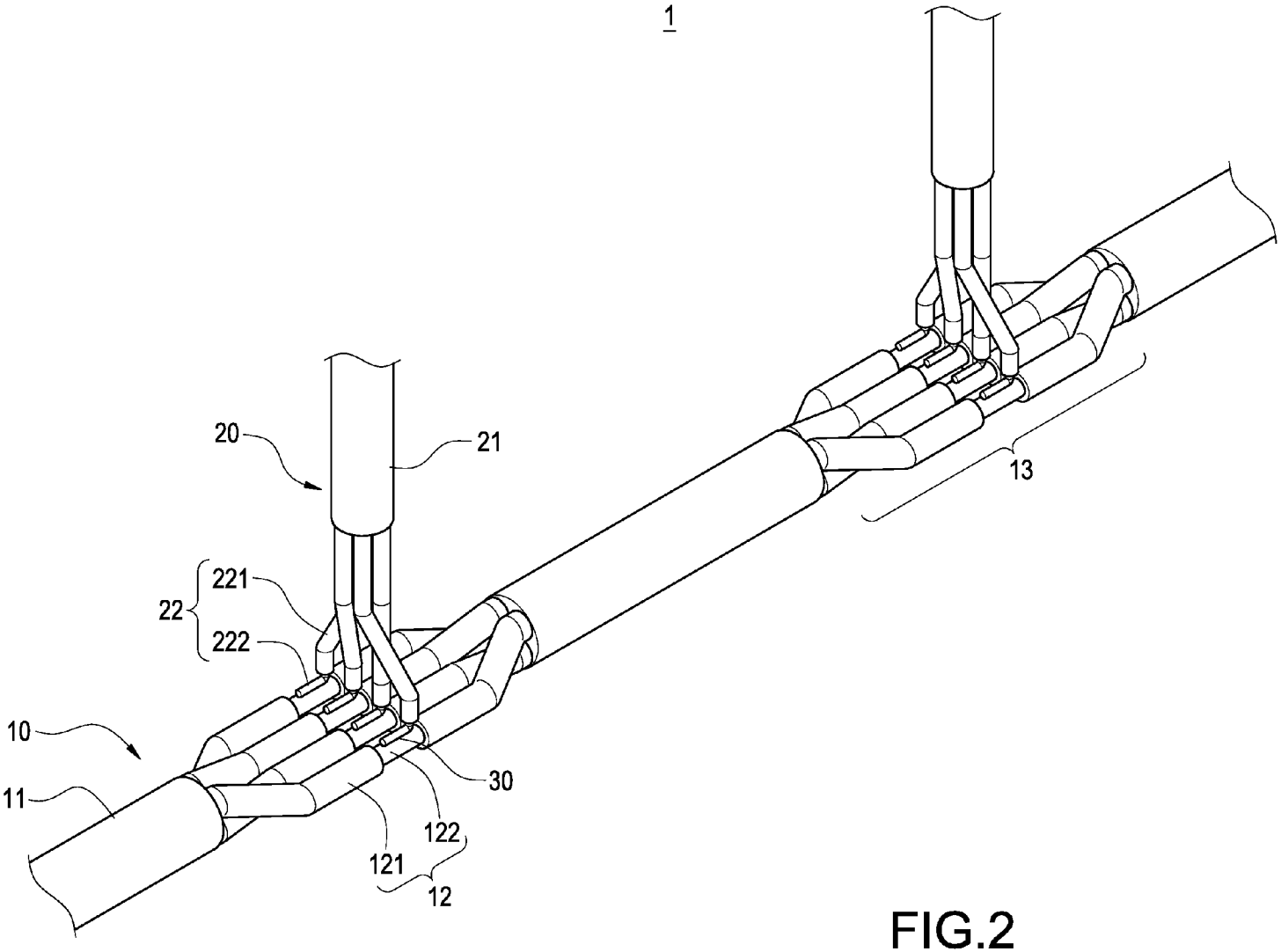
FIG. 2 is a perspective view showing the external appearance of a first embodiment of the present invention.
Figure 3:
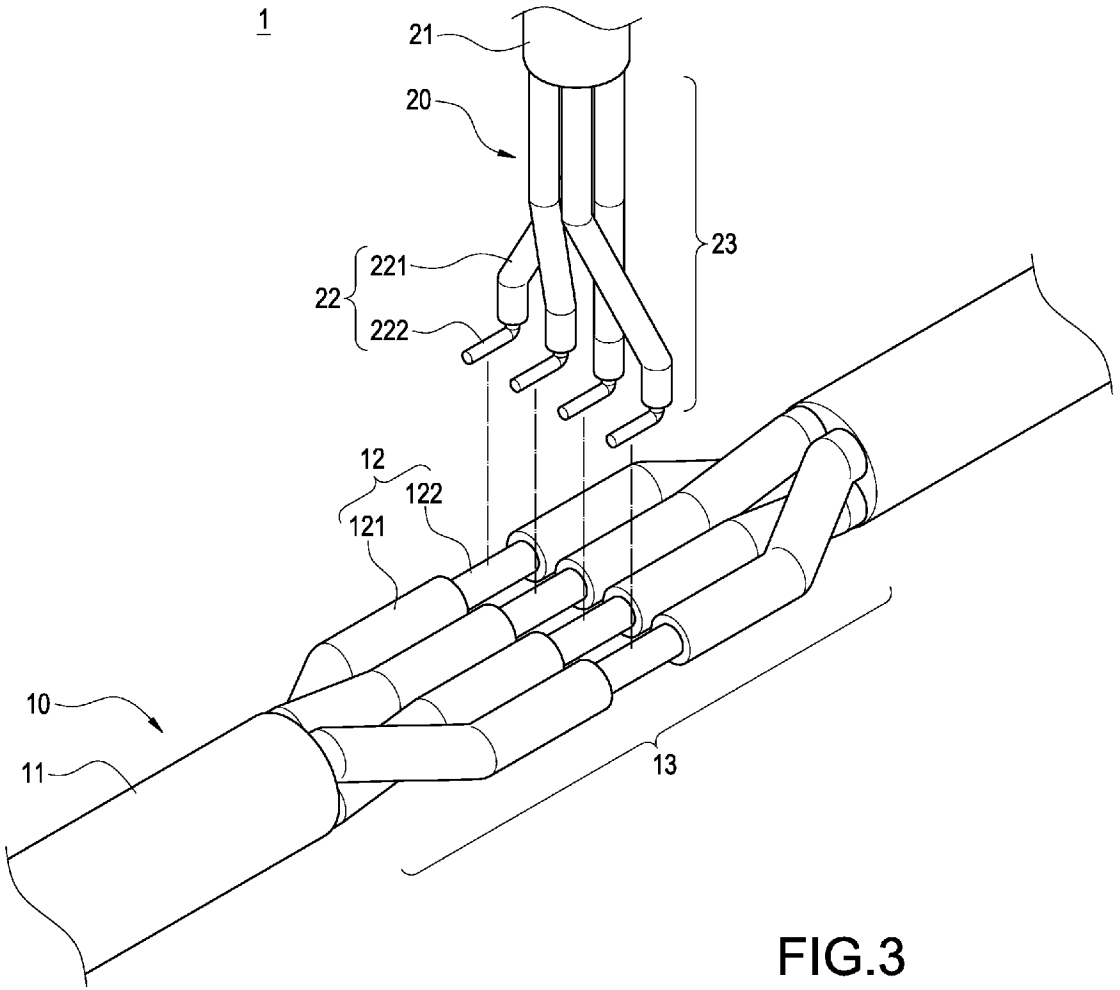
FIG. 3 is an exploded view showing the first embodiment of the present invention.
Figure 4:
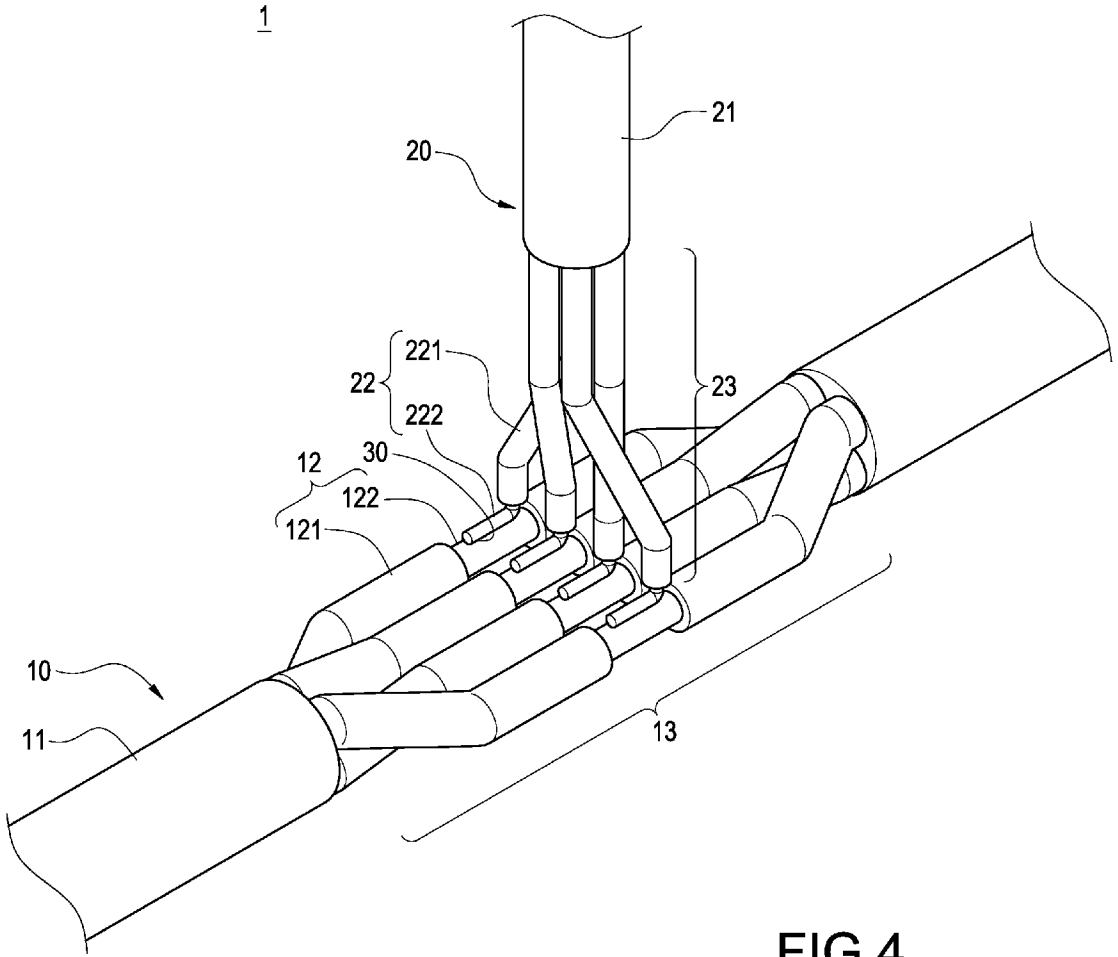
FIG. 4 is an assembled view showing the first embodiment of the present invention.

Please refer to FIGS. 1 to 4. The present invention provides an electrical-conductive assembly 1 for a signal cable and a connecting line. FIG. 1 shows that a signal cable 10 is connected with three connecting lines 20. One end of each connecting line 20 is provided with a signal module 100. Since the construction of the signal module 100 is well-known and not the characteristic of the present invention, the description thereof is omitted for simplicity.

The electrical-conductive assembly 1 of the present invention includes a signal cable 10, at least one connecting line 20, and an electrical connection means 30.

The signal cable 10 comprises an outer insulation cover 11 and a plurality of cores 12 located in the outer insulation cover 11. Each core 12 comprises a protective sheath 121 and a lead 122 located in the protective sheath 121. It can be seen from FIG. 2 that, the signal cable 10 has four cores 12. Each core 12 has a copper lead 122. The signal cable 10 is continuous (uncut) and provided with a plurality of electrical-conductive portions 13 whose number corresponds to the number of the connecting lines 20. The electrical-conductive portion 13 is not provided on both ends of the signal cable 10. The electrical-conductive portions 13 are arranged on the continuous signal cable 10 at intervals. A portion of the outer insulation cover 11 on each electrical-conductive portion 13 is removed (e.g. circumferentially pealed) to bare the cores 12. In each electrical-conductive portion 13, a portion of the protective layer 121 of each core 12 is removed (e.g. circumferentially pealed) to bare a section of the lead 122.

Each connecting line 20 has an outer insulation skin 21 and a plurality of cores 22 located in the outer insulation skin 21. The number of the cores 22 in the connecting line 20 corresponds to the number of the cores 12 in the signal cable 10

(four cores 22 in the present invention). Each core 22 has a protective layer 221 and a lead 222 located in the protective layer 221. One end of each connecting line 20 is provided with a connecting portion 23. A portion of the outer insulation skin 21 at one end of each connecting portion 23 is removed (e.g. circumferentially pealed) to bare the cores 22. A portion of the protective layer 221 of the core 22 in each connecting portion 23 is removed (e.g. circumferentially pealed) to bare a section of the lead 222.

The electrical connection means 30 is used for electrically connecting the cores 22 of the connecting portion 23 to the cores 12 of the electrical-conductive portion 13, so that the signal cable 10 is electrically connected to each connecting line 20 without cutting the signal cable 10.

According to the first embodiment shown in FIGS. 1 to 4, the electrical connection means 30 includes a plurality of soldering portions. More specifically, the bare section of lead 222 at the distal end of each core 22 of the connecting line 20 is bent to be disposed in the bare section 122 of lead of each core 12 on the electrical-conductive portion 13 of the signal cable 10. By means of an electrical soldering process, a plurality of soldering portions are provided between the bare section of lead 122 of the core 11 and the bare section of lead 222 of the core 22.

Figure 5:
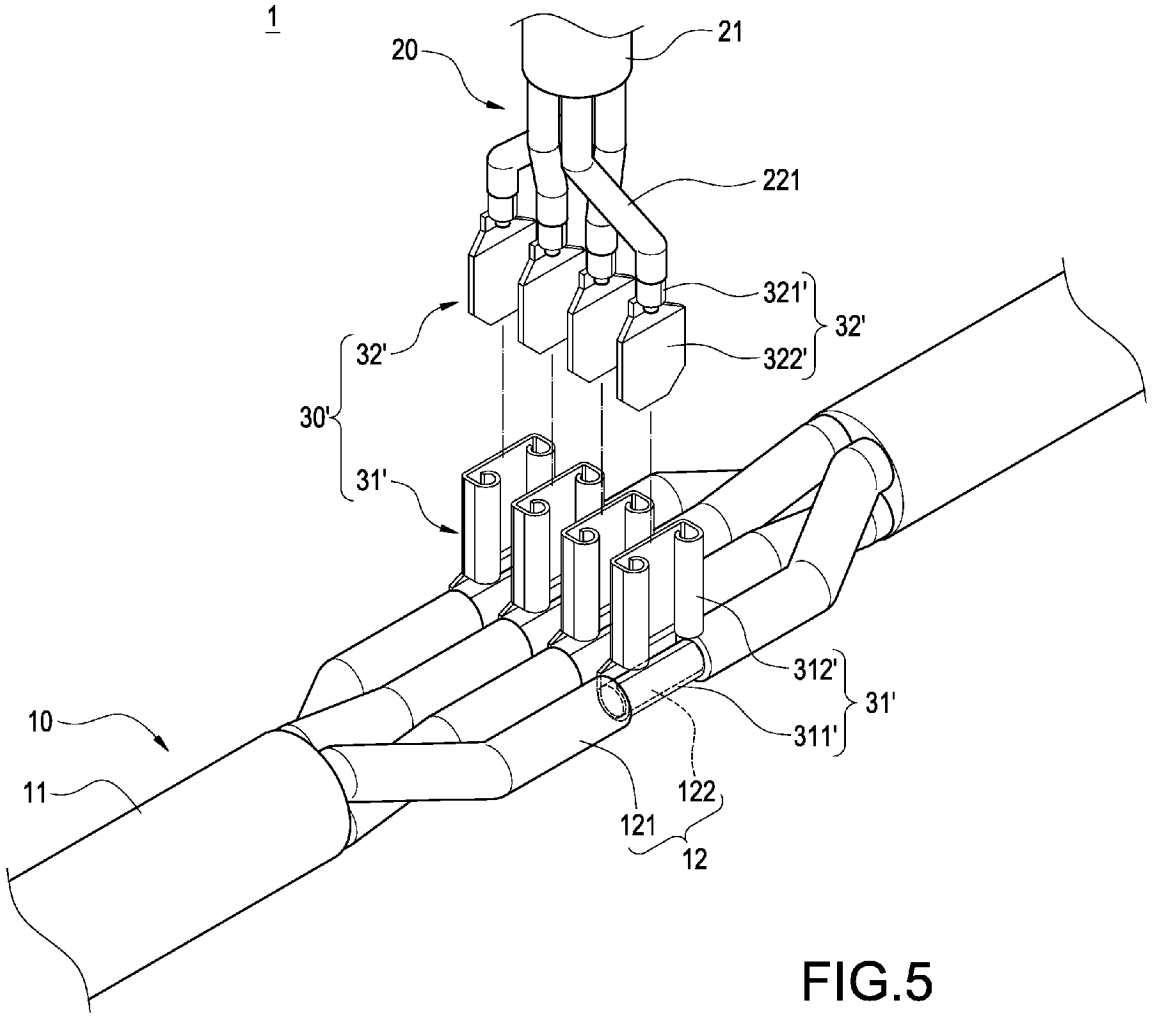
FIG. 5 is an exploded view showing a second embodiment of the present invention.
Figure 6:
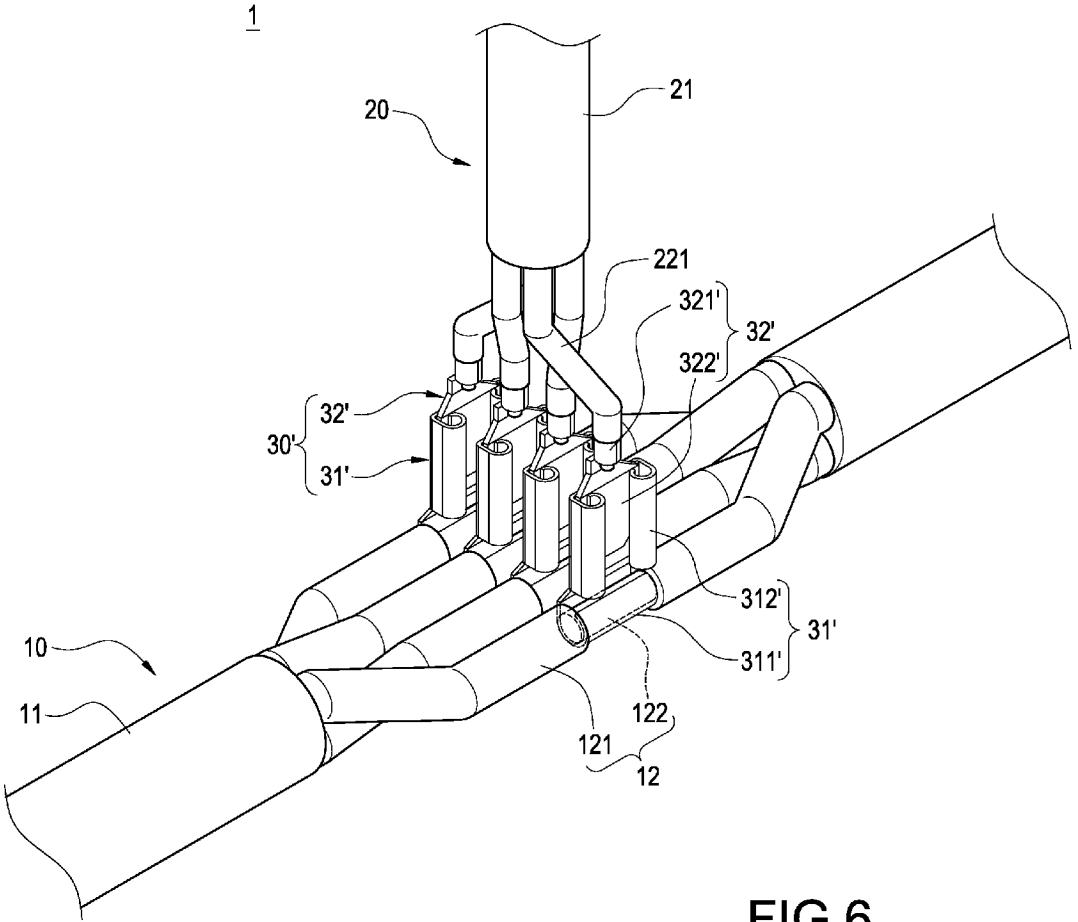
FIG. 6 is an assembled view showing the second embodiment of the present invention.

Please refer to FIGS. 5 and 6, which show the second embodiment of the present invention. The difference between the second embodiment and the first embodiment lies in that: the electrical connection means 30 is an electrical-conductive member 30' rather than a soldering portion. More specifically, the electrical-conductive member 30' is made of metallic materials having good electrical conductivity. The electrical-conductive member 30' includes a first electrical-conductive portion 31' and a second electrical-conductive portion 32'. The first electrical-conductive portion 31' is electrically connected to the bare section of lead 122 of the core 12 of the signal cable 10. The second electrical-conductive portion 32' is electrically connected to the bare section of lead 222 of the core 22 of the connecting line 20. The first electrical-conductive portion 31' comprises a covering section 311' covering the bare section of lead 122 of the core 12 and an insertion section 312' extending from the covering section 311'. The second electrical-conductive portion 32' comprises a fixing section 321' covering the base section of lead 222 (not shown) of the core 22 and an insertion piece 322' inserted into the insertion section 312'. In the second embodiment, the first electrical-conductive portion 31' and the second electrical-conductive portion 32' are provided to form the electrical-conductive member 30', thereby eliminating a soldering process.

Although the present invention has been described with reference to the foregoing preferred embodiments, it will be understood that the invention is not limited to the details thereof. Various equivalent variations and modifications can still occur to those skilled in this art in view of the teachings of the present invention. Thus, all such variations and equivalent modifications are also embraced within the scope of the invention as defined in the appended claims.

What is claimed is:

1. An electrical-conductive assembly for a signal cable and a connecting line, including:

a signal cable, comprising an outer insulation cover and a plurality of cores located in the outer insulation cover, the signal cable being continuous and provided with at least one electrical-conductive portion, a portion of the outer insulation cover on the electrical-conductive portion being removed to bare the cores;

at least one connecting line, having a plurality of cores therein, one end of the connecting line being provided with a connecting portion, the cores of the connecting line being bare in the connecting portion; and an electrical connection means, configured to electrically connect the cores of the connecting portion to the cores of the electrical-conductive portion, comprising:

a first electrical-conductive portion electrically connected to the bare section of lead on the core of the signal cable; and a second electrical-conductive portion electrically connected to the bare section of lead on the core of the connecting line;

wherein the first electrical-conductive portion and the second electrical-conductive portion are made of metallic materials and have high electrical conductivity; the first electrical-conductive portion comprises a covering section formed as a curved plate covering the bare section of lead on the core of the signal cable and an insertion section extending from the covering section, and two opposite edges of the insertion section are curved toward each other to form a clip structure; the second electrical-conductive portion comprises a fixing section covering the bare section of lead on the core of the connecting line and a flat insertion plate extending from the fixing section and inserted into the insertion section;

wherein the insertion section of the first electrical-conductive portion does not directly contact the bare section of lead on the core of the signal cable, and the flat insertion plate of the second electrical-conductive portion does not directly contact the bare section of lead on the core of the connecting line, and wherein the flat insertion plate of the second electrical-conductive portion is detachably inserted into the insertion section of the first electrical-conductive portion.

2. The electrical-conductive assembly for a signal cable and a connecting line according to claim 1, wherein each core of the signal cable comprises a protective layer and a lead located in the protective layer, each core of the connecting line also has a protective layer and a lead located in the protective layer, the number of the cores of the signal cable corresponds to the number of the cores of the connecting line.

3. The electrical-conductive assembly for a signal cable and a connecting line according to claim 2, wherein a portion of the protective layer of each core in the electrical-conductive portion is removed to form a bare section of lead, a portion of the protective layer of each core in the connecting portion is removed to form a bare section of lead.

4. The electrical-conductive assembly for a signal cable and a connecting line according to claim 3, wherein the electrical-conductive means includes a plurality of soldering portions, the soldering portions are provided between the bare section of lead on the cores of the signal cable and the bare section of lead on the cores of the connecting line.

* * * * *